United States Patent [19]

Baun

[11] Patent Number: 5,033,661

[45] Date of Patent: Jul. 23, 1991

[54] SCENTABLE CLOTHES HANGER ASSEMBLY

[75] Inventor: John T. Baun, Buffalo, N.Y.

[73] Assignee: Baun Wood Designs, Inc., Buffalo, N.Y.

[21] Appl. No.: 556,567

[22] Filed: Jul. 20, 1990

[51] Int. Cl.[5] ..... A47G 25/60; A47G 25/14

[52] U.S. Cl. ..... 223/86; 223/88

[58] Field of Search ..... 223/85, 88, 86, 92, 223/95; D6/315

[56] References Cited

U.S. PATENT DOCUMENTS

| | | | |
|---|---|---|---|
| 1,168,741 | 1/1916 | Potter | 223/86 |
| 2,094,355 | 9/1937 | Hadjosen | 223/88 |
| 2,187,691 | 1/1940 | Newhouse | 223/86 |
| 2,417,397 | 3/1947 | McCarthy | 223/86 |

FOREIGN PATENT DOCUMENTS

| | | | |
|---|---|---|---|
| 1109241 | 9/1955 | France | 223/86 |
| 1261277 | 4/1961 | France | 223/86 |
| 395472 | 12/1965 | Switzerland | 223/88 |
| 614790 | 12/1948 | United Kingdom | 223/86 |

*Primary Examiner*—Werner H. Schroeder
*Assistant Examiner*—Bibhu Mohanty
*Attorney, Agent, or Firm*—Hodgson Russ Andrews Woods & Goodyear

[57] ABSTRACT

A scentable wooden hanger assembly (10) having absorbent material (28) in a pluggable cavity (18), which material may receive a liquid fragrance for imparting the fragrance to the hanger assembly and the clothes hanging thereon. The hanger assembly includes two wooden side pieces (12, 14) formed of an uncoated porous wood, each side piece including a neck portion (12.1, 14.1) and a shoulder portion (12.2, 14.2). The neck portions are provided with first and second parallel cylindrical aligned bores (16, 18). The first set of bores (16) receives a dowel (24) which is glued in place to secure the side pieces together into a hanger body. The second set of aligned bores (18) receives absorbent material (28) which substantially fills the bores (18). A passageway (22) extends between a second bore and the surface of one of the side pieces, which passageway may be closed by a plug (32). An upwardly extending hook (30) is secured to the hanger body. A clothes bar (26) may extend between the shoulder portions.

14 Claims, 1 Drawing Sheet

SCENTABLE CLOTHES HANGER ASSEMBLY

FIELD OF THE INVENTION

The present invention relates generally to a hanger assembly of the type used for hanging clothes, and more particularly to a scentable wooden clothes hanger assembly having an internal cavity which is provided with an absorbent material in direct contact with the wood, which absorbent material may receive a liquid fragrance for imparting the fragrance to the hanger assembly and the clothes hanging thereon.

BACKGROUND OF THE INVENTION

It is well known in the art to provide hangers with sachets for imparting a desired fragrance to clothing. It is also well known in the art that a clothes hanger may be provided with a special receptacle for moth balls and the like, typical prior art examples being shown in U.S. Pat. Nos. 1,168,741, 2,187,691, and 2,417,397.

OBJECTS AND SUMMARY OF THE PRESENT INVENTION

It is an object of the present invention to provide a scentable clothes hanger assembly made of a porous wood, which wood is provided with an internal cavity substantially filled with an absorbent material which may receive a liquid fragrance, the essence of which may pass through the wood by capillary action and be vaporized from the surface of the wood to impart fragrance to the hanger assembly and the clothes hanging thereon.

More particularly, it is an object of the present invention to provide a scentable clothes hanger assembly including first and second side pieces made of wood, at least one of the wooden side pieces being provided with an internal cavity and a passageway extending from the surface of the wooden side piece to the cavity, the side pieces being secured to each other to form a hanger body, and where an absorbent material is disposed within the cavity in direct contact with the wood, which absorbent material may retain a liquid fragrance, which fragrance may pass through the wood by capillary action and be vaporized from the surface of the wood.

It is a further object of the present invention to provide a scentable clothes hanger assembly of the type referred to above which may be easily constructed.

It is a further object of the present invention to provide a scentable wood hanger assembly of the type referred to above, which hanger is of sturdy construction and of pleasing appearance.

The scentable wood hanger of this invention may be made by providing first and second wooden side pieces made of a porous wood such as red oak or ash, which wood is not coated or varnished in any manner. Each side piece includes a neck portion and a shoulder portion. Each neck portion is provided with upper and lower cylindrical bores, and the bores in one neck portion can be placed in alignment with the bores in the other neck portion. A dowel is glued within the upper pair of the bores to hold the side portions together and an absorbent material, such as a dental roll, is placed in the lower pair of aligned bores. A narrow passageway extends from an exterior surface of one of the side pieces to the associated lower bore, which passageway may be closed off by a removable plug. The hanger assembly further includes a hook, and may include a clothes bar which extends between the shoulder portions.

The foregoing construction as well as further objects and advantages of this invention will become more apparent after a consideration of the following detailed description taken in conjunction with the accompanying drawings in which a preferred form of this invention is illustrated.

DETAILED DESCRIPTION

Figure 2:
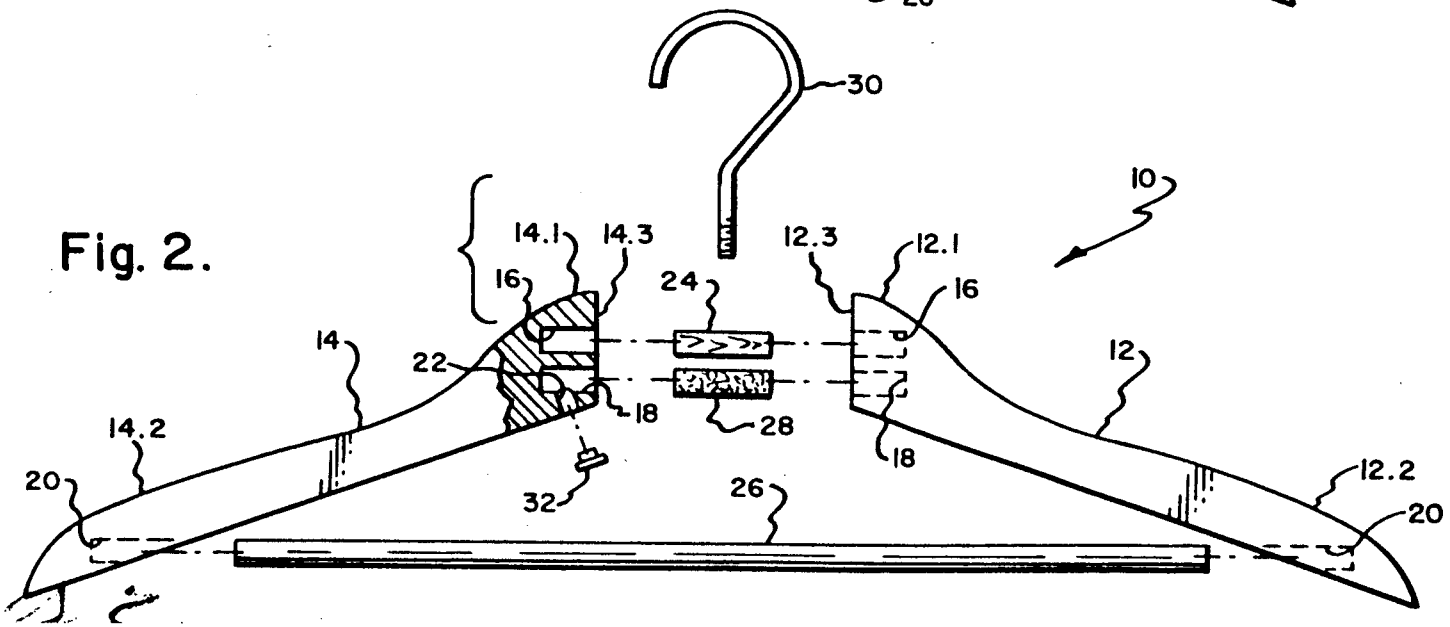
FIG. 2 is an exploded side view of the scentable clothes hanger assembly of this invention.

The scentable clothes hanger assembly of this invention is indicated generally at 10. The manger assembly of the preferred mode includes first and second side pieces 12 and 14, respectively, formed of a porous wood. Preferred porous woods include red oak and ash. Each of the side pieces includes a neck portion and a shoulder portion. Thus, the first side piece is provided with a neck portion 12.1 and a shoulder portion 12.2. Similarly, the second side piece is provided with a neck portion 14.1 and a shoulder portion 14 2. The neck portion of each of the side pieces 12 and 14 terminates in a vertical planar surface 12.3 or 14.3. Drilled into each of the neck portions 12.1 and 14.1 are first and second cylindrical bores 16, 18, these bores being perpendicular to the vertical surfaces 12.3 or 14.3. As can best be seen from FIG. 2 the bores 16 and 18 are closely spaced to each other and are parallel thereto. As can also be seen from FIG. 2 the bores are so designed that when the side pieces 12 and 14 are placed in abutting assembled relationship they will be in alignment. Thus, the first set of cylindrical bores 16 will be in alignment with each other as well as the second set of cylindrical bores 18 being in alignment with each other. The shoulder portion 12.2 or 14.2 of each of the side pieces may also be provided with a third cylindrical bore 20, which third bore 20 is also parallel to the first and second bores 16 and 18. A passageway 22 is provided in one of the side pieces, as for example side piece 14, the passageway extending from an exterior surface of the side piece to the second bore 18.

The first and second side pieces are secured to each other to form a hanger body. To this end a dowel 24 is glued within the first set of bores 16, the first surfaces 12.3 and 14.3 also being glued to each other. It may also be desirable to assemble a further dowel or clothes rod 26 to the hanger body, the ends of the clothes rod being received within the third set of cylindrical bores 20. During assembly an absorbent material, for example a dental roll 28, is placed within the second set of aligned bores 18, the absorbent material substantially filling the internal cavity formed by the aligned juxtapositioned bores 18.

The scentable wood clothes hanger assembly of this invention is completed by screwing or otherwise securing an upwardly extending hook 30 to the hanger body. While a screwed in hook is illustrated, it should be appreciated that other forms of hook designs may be utilized, such other forms being well known to those having ordinary skill in the art. In addition, while a clothes bar is shown, it should be appreciated that the hanger assembly need not include a clothes bar. Additionally, it may embody skirt clips, a locking dowel, or other devices well known to those of having skill in the art.

Figure 1:
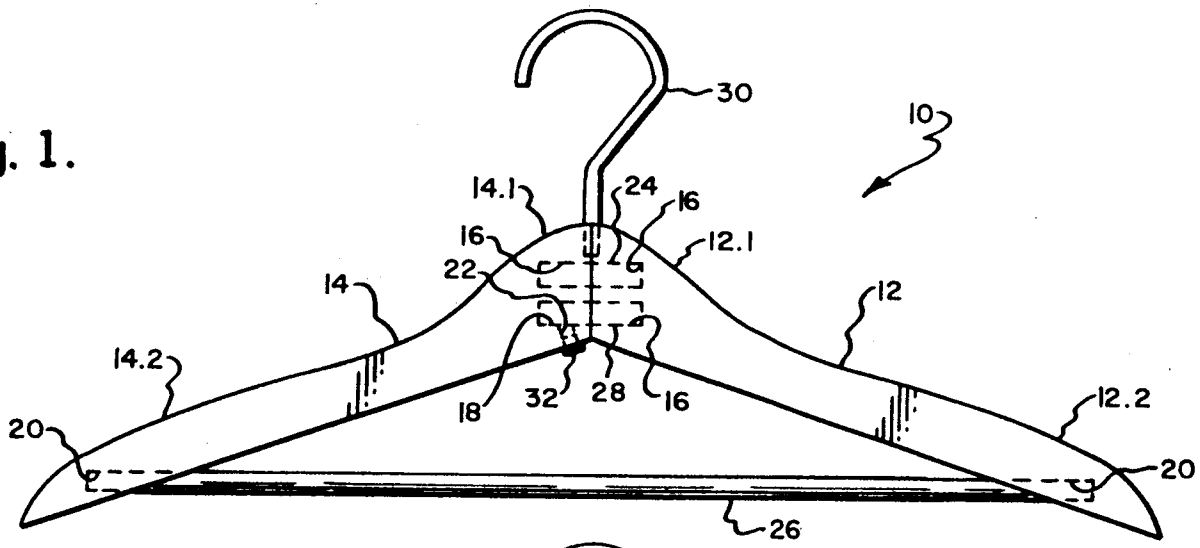
FIG. 1 is a side view of the scentable clothes hanger assembly of this invention.

It is a particular feature of this invention that the absorbent material 28 may retain liquid fragrances, such as perfumes or colognes, for imparting the scent of the fragrance to both the wooden hanger and the clothes hanging thereon. To this end, after the hanger has been assembled in the manner shown in FIG. 1, a plug 32, which is utilized to close the passageway 22, is removed and the desired liquid scent material is poured into the passageway, the liquid fragrance flowing therefrom into the absorbent material 28. When no more liquid fragrance can be absorbed by the absorbent material 28 the plug is replaced in the passageway to retain the fragrance therein. As the absorbent material 28 is in direct contact with the wooden side pieces 12 and 14, the fragrance may flow from the absorbent material into the wood by capillary action, and the volatiles in the liquid fragrance are discharged from the surface of the wood into the atmosphere and also to the clothes which may be ranging on the hanger.

It can be seen from the above that a scentable clothes hanger has been developed which can be readily made by existing tooling available in the wooden clothes hanger industry.

While a preferred design has been described above and is shown in the accompanying drawings, it is to be understood that this invention is not to be limited to the particular details shown or described, but that, in fact, widely differing designs may be employed in the practices of the broader aspects of this invention.

What is claimed is:

1. A scentable hanger assembly which may receive fragrances; said assembly comprising:

a hanger body made of porous wood, the hanger body including a neck portion and first and second shoulder portions, the hanger body being provided with large diameter internal cavity and a narrow diameter passageway extending from the surface of the hanger body to the internal cavity;

an upwardly extending hook secured to the hanger body;

an absorbent material disposed within the internal cavity in direct contact with the wood, the absorbent material having a larger diameter than the passageway and substantially filling the internal cavity; and a removable plug closing the end of the passageway adjacent the surface said plug being removable when it is desired to introduce a liquid fragrance into the internal cavity to be retained by the absorbent material, which fragrance may be passed through the wood by capillary action and be vaporized from the surface of the wood.

2. The scentable hanger assembly as set forth in claim 1 wherein the hanger body is formed from the first and second side pieces, each side piece including a neck portion and a shoulder portion; the hanger assembly further including securing means for assembling the neck portions of the first and second side pieces together.

3. The scentable hanger assembly as set forth in claim 2 wherein the securing means includes a dowel which extends between the two wooden side pieces.

4. The scentable hanger assembly as set for in claim 2 wherein the adjacent portions of the two side pieces are machined the securing means including an adhesive which joins the two machined portions.

5. The scentable hanger assembly as set forth in claim 2 wherein each of the wooden side pieces is provided with a large diameter internal cavity.

6. The scentable hanger assembly as set forth in claim 5 wherein the internal cavities in the two side pieces are in aligned juxtapositioned relationship to each other when the side pieces are secured together.

7. The scentable hanger assembly as set forth in claim 6 wherein the securing means includes a dowel which extends between the two wooden side pieces.

8. The scentable hanger assembly as set forth in claim 7 wherein the dowel is received by a first set of cylindrical bores in the neck portions, the liquid fragrance receiving cavities being parallel to and spaced away from the dowel receiving bores by only a small distance not substantially greater than the diameter of a dowel.

9. The scentable hanger assembly as set forth in claim 8 wherein the absorbent material is a dental roll.

10. The scentable hanger assembly as set forth in claim 2 wherein the assembly further includes a bar extending between the shoulder portions of the two side pieces.

11. The scentable hanger assembly as set forth in claim 1 wherein the hanger body is not coated or varnished in any manner.

12. The scentable hanger assembly as set forth in claim 11 wherein the hanger body is made from red oak.

13. The scentable hanger assembly as set forth in claim 11 wherein the hanger body is made from ash wood.

14. A scentable hanger assembly which may receive liquid fragrances; said assembly comprising:

first and second side pieces made of a porous wood which is not coated or varnished in any manner, each side piece including a neck portion and a shoulder portion, the neck portion of each of the first and second side pieces being provided with spaced apart first and second cylindrical bores, the bores in the first side piece being in alignment with the bores in the second side piece, and one of the first and second side pieces being provided with a passageway which extends between the second bore and the surface of the side piece;

a dowel glued within the first cylindrical bores to secure the first and second side pieces together to form a hanger body;

absorbent material substantially filling the second cylindrical bores; and a removable plug disposed within the exterior end of the passageway for closing off the passageway.

* * * * *